US006507145B1

(12) United States Patent
Turlot et al.

(10) Patent No.: US 6,507,145 B1
(45) Date of Patent: Jan. 14, 2003

(54) BALLAST LAYER FOR FIELD EMISSIVE DEVICE

(75) Inventors: Emmanuel Turlot, Villebon sur Yvette; Hanh Pham, Neuilly sur Marne, both of (FR); François Leblanc, Sargans (CH); Jacques Schmitt, La Ville du Bois (FR)

(73) Assignee: Balzers AG, Balzers (LI)

( * ) Notice: Subject to any disclaimer, the term of this patent is extended or adjusted under 35 U.S.C. 154(b) by 0 days.

(21) Appl. No.: 09/497,341

(22) Filed: Feb. 3, 2000

(51) Int. Cl.[7] ..... H01J 63/02

(52) U.S. Cl. ..... 313/495; 313/497; 313/309; 313/336; 313/351

(58) Field of Search ..... 313/336, 351, 313/309, 307, 497, 498, 502, 504; 438/20, 28, 22, 455, 480; 252/188.25, 301.36, 301; 257/10, 11, 79, 76, 78; 428/426, 428, 429, 690; 445/24; 315/169.1

(56) References Cited

U.S. PATENT DOCUMENTS

| | | | | | |
|---|---|---|---|---|---|
| 5,789,851 | A | | 8/1998 | Turlot et al. | 313/336 |
| 5,852,346 | A | * | 12/1998 | Komoda et al. | 315/169.3 |
| 6,060,743 | A | * | 5/2000 | Sugiyama et al. | 257/321 |
| 6,064,149 | A | * | 5/2000 | Raina | 313/309 |
| 6,137,214 | A | * | 10/2000 | Raina | 313/309 |
| 6,139,385 | A | * | 10/2000 | Raina | 445/24 |

* cited by examiner

*Primary Examiner*—Sandra O'Shea
*Assistant Examiner*—Ismael Negron
(74) *Attorney, Agent, or Firm*—Crowell & Moring LLP

(57) ABSTRACT

A ballast layer for a field emissive device includes a very thin layer of strongly doped nanocrystalline silicon and one or more moderately doped layers of an amorphous silicon-based material.

14 Claims, 5 Drawing Sheets

BALLAST LAYER FOR FIELD EMISSIVE DEVICE

BACKGROUND AND SUMMARY OF INVENTION

The present invention is directed to a ballast layer for field emissive device (FED) flat displays. The field emissive device used in FED displays is a point emitter that emits a flow of electrons in a vacuum under the influence of a moderate extraction voltage. Point emitters are based either on (1) field emission, in which a large field is generated by a very sharp angle at the tip of the emitter, or (2) special low work function materials such as diamond.

A pixel of an FED display is made of a large number of adjacent point emitters operating in parallel to cover the full surface of the pixel. One of the key problems in the design of such a display is that a point emitter tends to operate with a "negative" resistance. Thus, when a set of emitters run in parallel, they tend to have an arc-like behavior (i.e., one emitter takes over all the current and the other emitters are inhibited). A solution to this problem was proposed by A. Ghis et al., *IEEE Transactions* on electron devices, Vol. 38, No. 10 (October 1991). This solution is based on a resistive ballast layer that interconnects the emitters and the source line. The added series resistance compensates for the negative resistance of the point emitters, thereby allowing a stable, parallel operation of adjacent point emitters.

The ballast layer, however, is particularly difficult to manufacture. The required resistivity for the ballast layer in an FED is in the range of $10^2$ to $10^5$ Ohm centimeter, corresponding to a conductivity ($\sigma$) of less that $10^{-2}$ Ohm $cm^{-1}$. This range of resistivity is too large to be achieved with conventional metal alloys. Although this range of conductivity can be achieved by lightly-doped semiconductors, these materials are very sensitive to minute fluctuations of doping levels and are very difficult to use for a stable production.

U.S. Pat. No. 5,789,851 describes obtaining a controlled resistance using a resistive layer comprising doped amorphous silicon film alloyed with another element, such as carbon or phosphorous. U.S. Pat. No. 5,789,851 also describes a way of manufacturing a ballast layer in a controlled manner compatible with production.

However, a new specification was introduced by the FED industry that makes the ballast layer design even more difficult to achieve. It is now required for the ballast layer to have the same type of sheet resistance over the full range of operating temperatures that occur for the most demanding FED display users (e.g., the car industry or military applications). This temperature range is typically within the range of −50° C. to 100° C. Thus, the resistance which a ballast layer introduces in an emitter circuit should vary by no more than a factor 3–6 over the −50 to +100° C. temperature range (e.g., $\sigma(90°\ C.)/\sigma(-50°\ C.)<5$). This requirement adds to the constraint on the ballast layer resistivity. The square resistance of the ballast layer should be larger than a few megaOhm. Thus, the material resistance of a 300 nm ballast layer, for example, is in excess of 100 Ohm centimeter.

Unfortunately, semiconductors are known to have a rather large variation of conductivity with temperature, and this new specification for the ballast layer severely increases the difficulty in ballast layer design. Conductivity increases rapidly with temperature (at least in the range of −50° C. to 100° C.) according to the general relation:

$$\sigma=\sigma_0 \exp(-E_a/kT)$$

where $\sigma$ is conductivity; k is the Bolzmann constant; T is absolute temperature; and $E_a$ is the activation energy, which is generally related to the position of the Fermi level in the particular semiconductor. The activation energy can vary strongly in a given semiconductor with the doping level. Basically, an intrinsic (or compensated) material is rather resistive and has a rather large activation energy (of the order of half of the semiconductor forbidden band gap). In contrast, a doped material has a small activation energy, but is rather conductive.

The relative variations of the conductivity of a semiconductor over the −50 to +100° C. temperature range are shown in FIG. 2. The acceptable variation should remain below the threshold. As illustrated in FIG. 2, the conductivity variation is within the requirement for FED manufacturing only for an activation energy well below 0.1 eV. This value of activation energy is very low and, as known in the silicon industry, corresponds to very high level of doping, for example a doping concentration of $3\times10^{17}$ $cm^{-3}$ or above. Sze, *Physics of Semiconductor Devices,* pages 37 and 43 (1969). For an doping concentration above $3\times10^{17}$ $cm^{-3}$, the resistivity of silicon is lower than 0.2 Ohm cm for p-type Si and lower than 0.05 Ohm cm for n-type Si. However, in both cases, the doped silicon is more than 500 times too conductive with respect to the estimated specification for FED applications.

Thus, semiconductors such as silicon cannot meet the specifications of (1) a conductivity of less than $10^{-2}$ Ohm $cm^{-1}$ and (2) a variation of resistance corresponding to &(90° C.)/&(−50° C.) less than 5. FIG. 3 shows the evaluation of many different types of amorphous (a-Si:H) silicon, nanocrystalline silicon, and silicon-carbon alloys. G. Lucovsky and C. Wang, *Mat. Res. Soc. Symp. Proc.,* page 377, Vol. 219 (1991). As illustrated in FIG. 3, the data form a scattered cloud of points in a plot of activation energy against resistivity at room temperature. Two model curves are also shown in FIG. 3. All of the materials are far away from the zone of interest for FED applications, either because the material is too conductive (by more than a factor 20), or because the material has too much temperature variation for its conductivity (activation energy in excess of 0.18 eV). Among the thin films based on plasma-enhanced chemical vapor deposition (PECVD) deposited silicon, only nanocrystalline films with strong doping (e.g., n-doped films with $PH_3$ based doping) achieve an activation energy below 0.1 eV. Unfortunately, the conductivity of such film is 30 to 100 times larger than the smallest conductivity required for FED applications.

The problem is that low activation energy and high conductivity always occur together for semiconductors. The FED ballast layer application runs into a very basic problem intrinsic to the semiconductor structure. The ballast layer according to the present invention solves this problem.

Other objects, advantages and novel features of the present invention will become apparent from the following detailed description of the invention when considered in conjunction with the accompanying drawings.

DETAILED DESCRIPTION OF THE DRAWINGS

Figure 1:
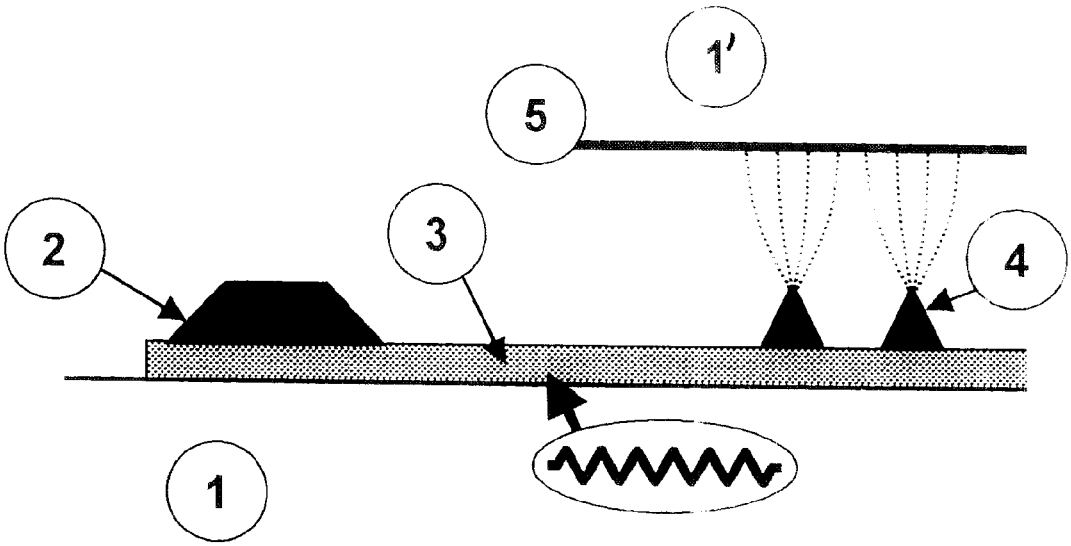
Figure 1 PRIOR ART
FIG. 1 is a schematic view of a FED display system.
Figure 2:
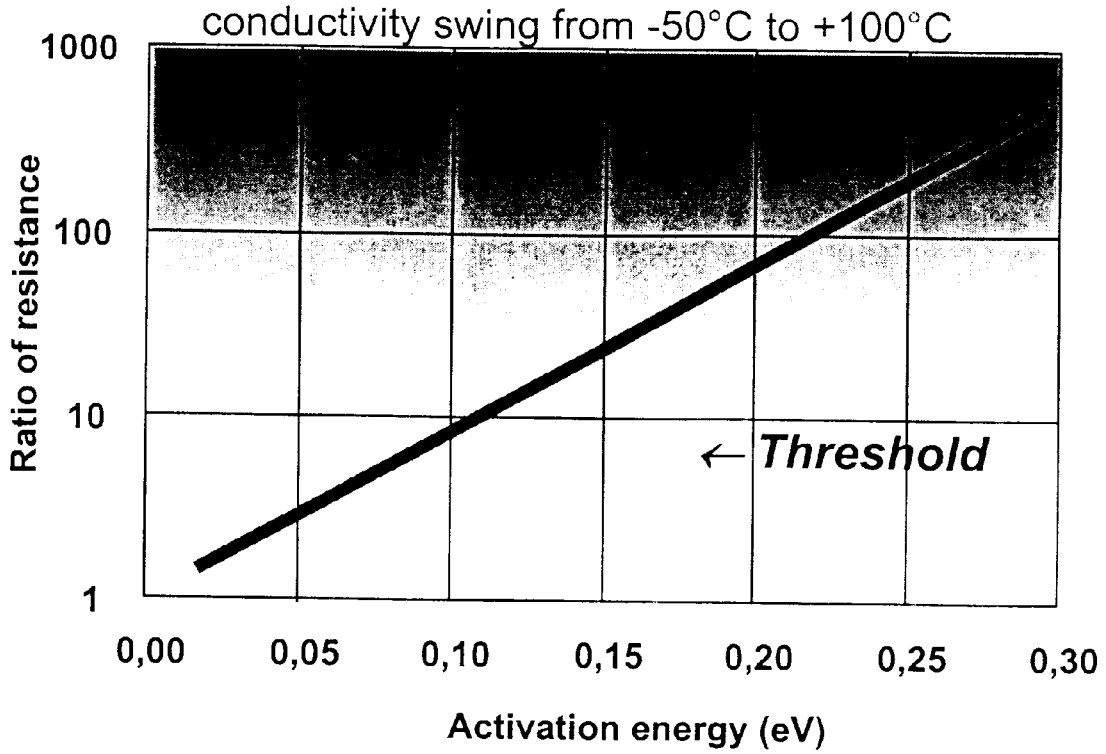
FIG. 2 is a graph showing the relative variations of the conductivity of a semiconductor in the temperature range of −50 to +100° C. range.
Figure 3:
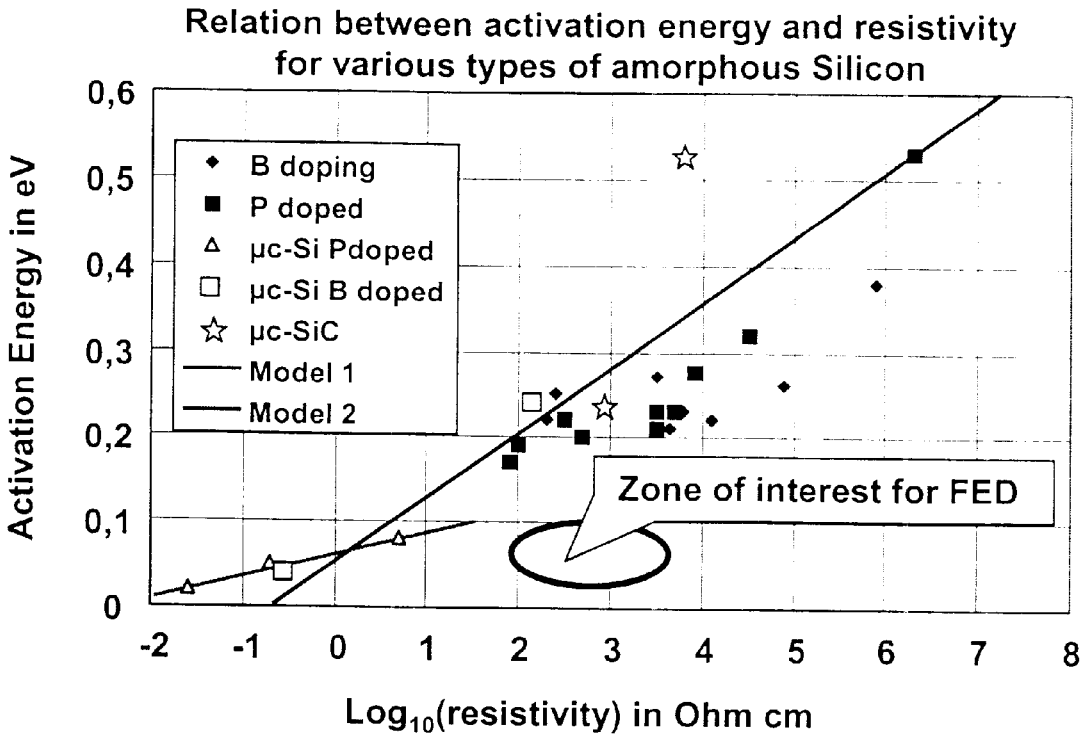
FIG. 3 is a graph showing resistivity at room temperature and the activation energy for many different types of amorphous and nanocrystalline silicon films.

Some of the key components of a FED display are shown in FIG. 1. FIG. 1 omits other components of an FED display (e.g., the control grid, the phosphors, and the like) to focus on the specific parts of a FED system that are relevant to the present invention. FIG. 1 shows glass substrates 1 and 1'closing the vacuum cell of the FED display; a metal line 2 bringing the supply voltage to the pixel; a ballast layer 3 with a resistor symbol to make its function explicit; point emitters 4 represented as sharp cones; and counter electrode 5 (anode).

According to the present invention, the ballast layer has a thickness between about 150 nm to about 400 nm. If thinner, the ballast layer would be difficult to manufacture. The manufacturing process of a FED display includes etching a thick insulator layer and stopping the etching process on the top of the ballast layer to recover the contact. If the ballast layer is too thin, there is a great risk of etching through during manufacturing. If the ballast layer is too thick, the layer will take very long to deposit and to be etched, hence the manufacturing cost will be too large. In the following description, a thickness of 300 nm for the ballast layer is used. This value is not to be construed as a limitation of the process.

The present invention consists in forming a multilayered ballast layer with several combined films. A very thin nanocrystalline layer with a large doping level is combined with one or more thicker, slightly doped, amorphous layers (silicon or alloy) that are more resistive than the thin nanocrystalline layer. A strongly doped, thin nc-Si layer is associated with one or more moderately doped, thicker layers of amorphous s silicon or alloy. The conductivity of the a-Si layers must be low enough for the total multilayer electric behavior to be dominated by the nc-Si layer conductivity.

In embodiments, the thin nanocrystalline film may have (1) a thickness of about 15 nm; (2) a resistivity slightly above 1 ohm cm; and (3) an activation energy smaller than 0.1 eV. Such a nanocrystalline film has a square resistance of about 6–7 megaOhm. A film of 15 nm is feasible with PECVD deposition of nanocrystalline silicon doped with phosphorus. The typical deposition rate for nc-Si is low (about 0.1 nm/s) and the deposition time of such a layer is of the order of 2–3 minutes, which is a sufficient time to provide good layer thickness control.

Figure 4:
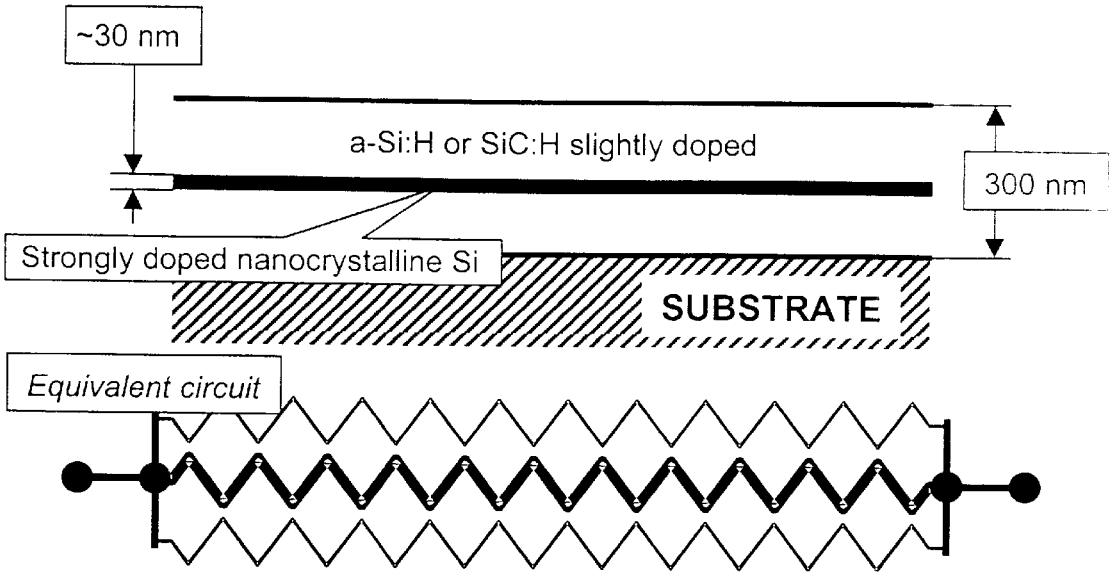
FIG. 4 is a schematic of the ballast layer according to the present invention.

As shown in FIG. 4, a nanocrystalline doped silicon layer is sandwiched between 2 layers. The total ballast layer thickness is about 10 times thicker than the nc-Si layer. The resistance of the overlapped layers are in parallel. The thick amorphous layers are conductive to smoothen the conductivity of the nc-Si layer (across steps, for example), but the contribution to the global square resistance of the amorphous layers should only be a minority contribution to the net square resistance. In fact, the thermal variation of the resistivity of the a-Si is large because the activation energy exceeds 0.1 eV. Because the a-Si's contribution to the film remains a small fraction, too great a variation of the net square resistance with temperature is avoided.

EXAMPLE

A ballast layer was made of the combination of 2 known materials, as described in the Table below:

| Material type | Room temp. resistivity | Activation Energy | Thickness |
|---|---|---|---|
| nc-SI (n doped) | 8 Ohm cm | 0.08 eV | 20 nm |
| a-SiC:H (n doped) | 1200 Ohm cm | 0.28 eV | 360 nm |

The ballast layer was deposited by first depositing an a-Si layer and then the nc-Si layer. During the PECVD deposition of the nc-Si layer, there is a delay before the film starts growing as microcrystalline. This incubation phase is well known (S. Hamma and P. Roca i Cabarrocas, *J. Appl. Phys.,* 81 (11) (1997)) and was accounted for by adjusting the deposition time after several test runs.

Figure 5:
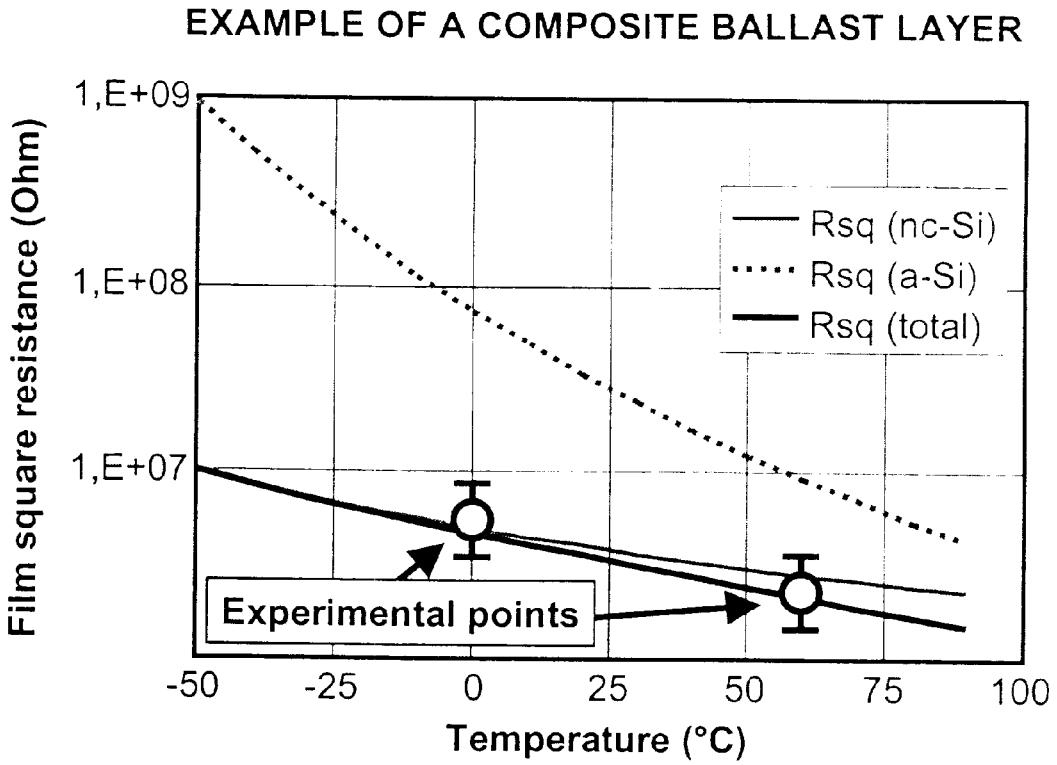
FIG. 5 is a graph showing the calculated variations of the square resistance of two films comprising a ballast layer as a function of temperature according to the present invention.

FIG. 5 shows the square resistance (calculated by combining the values from the two materials used for making this ballast layer) as a function of temperature. Two experimental points were measured and are shown to fit with the estimation based on the single film properties.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A ballast layer for a field emissive device, comprising:

a thin layer of doped, nanocrystalline silicon; and one or more doped layers of an amorphous silicon-based material.

2. A ballast layer according to claim 1, wherein the doped, nanocrystalline silicon has a thickness ranging from 10 to 100 nm.

3. A ballast layer according to claim 1, wherein the one or more doped layers of amorphous silicon-based material has a total thickness more than four times larger than the doped, nanocrystalline silicon layer.

4. A ballast layer according to claim 3, wherein the total thickness of the one or more doped layers of an amorphous silicon-based material is 5 to 10 times larger than the nanocrystalline silicon layer.

5. A ballast layer according to claim 1, wherein the one or more doped layers of an amorphous silicon-based material has a resistivity at room temperature of at least 100 times larger than a resistivity of the nanocrystalline silicon layer.

6. A ballast layer according to claim 1, wherein the doping of the nanocrystalline silicon layer and the one or more doped layers of an amorphous silicon-based material are of the same type.

7. A ballast layer according to claim 6, wherein the doping of the nanocrystalline silicon layer and the one or more doped layers of an amorphous silicon-based material is n-doping.

8. A ballast layer according to claim 1, wherein the nanocrystalline silicon layer is sandwiched between the one or more doped layers of an amorphous silicon-based material.

9. A ballast layer according to claim 1 having a conductivity less than $10^{-2}$ Ohm $cm^{-1}$.

10. A ballast layer according to claim 1 having a conductivity ratio of conductivity at 90° C./conductivity at −50° C. of less than 5.

11. A ballast layer according to claim 1 having a thickness of about 150 nm to about 400 nm.

12. A field emissive device comprising a ballast layer according to claim 1.

13. A display comprising a field emissive device according to claim 12.

14. A ballast layer for a field emissive device, consisting of:

a thin layer of doped, nanocrystalline silicon; and one or more doped layers of an amorphous silicon-based material.

* * * * *